United States Patent [19]

Brom

[11] 4,196,807

[45] Apr. 8, 1980

[54] UNIVERSAL CUP CARRIER

[75] Inventor: Lawrence V. Brom, Jackson, Miss.

[73] Assignee: Consolidated Packaging Corporation, Chicago, Ill.

[21] Appl. No.: 941,761

[22] Filed: Sep. 13, 1978

[51] Int. Cl.[2] ..... B65D 85/62

[52] U.S. Cl. ..... 206/427; 206/197; 224/45 AA; 229/28 R; 294/87.2

[58] Field of Search ..... 206/427, 426, 197, 199; 229/28 R; 224/45, 45 AA, 45 AB; 294/87.2, 87.28

[56] References Cited

U.S. PATENT DOCUMENTS

| | | | |
|---|---|---|---|
| 2,397,716 | 4/1946 | Wendler | 224/45 AA |
| 2,887,265 | 5/1959 | Glaser | 229/28 R |
| 3,686,140 | 2/1975 | Gordon | 206/427 |

*Primary Examiner*—William T. Dixson, Jr.
*Attorney, Agent, or Firm*—Hugh Adam Kirk

[57] ABSTRACT

A single folded fiberboard carrier for an even number of drinking vessels of varying shapes and sizes, having a central vertical handle portion or section, a divergent pair of apertured panels hinged to the handle portion and a convergent pair of apertured panels hinged from said divergent panels and hinged together at their bottom. The apertures in these pairs of panels are for clamping the conical or frusto-conical sides of the paper or plastic drinking cups suspended in the carrier, and for preventing tilting or spilling of the contents in the cups when the carrier is at rest and the cups are supported on their bottoms. The vertical handle portion is apertured for grasping with the fingers of one's hand. The divergent panels have elongated cup body engaging apertures with semicircular floating collars hinged at their ends diametrically of the apertures for engaging the upper sides of different size and tapered frusto-conical cups. The convergent panels also have elongated but slightly smaller apertures vertically aligned with the apertures in the divergent panels.

22 Claims, 9 Drawing Figures

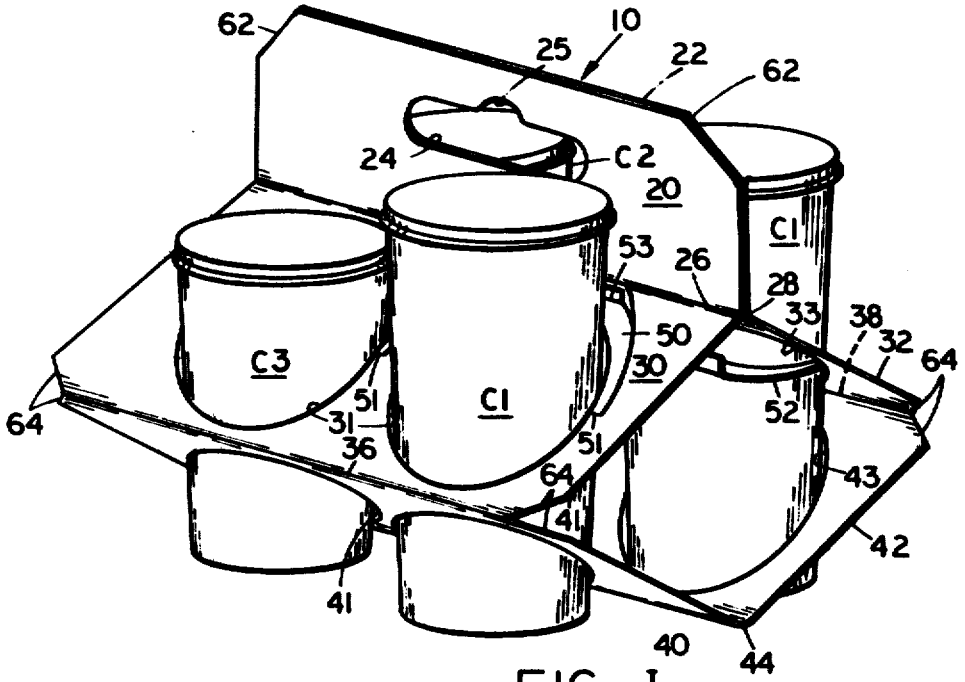
FIG. I
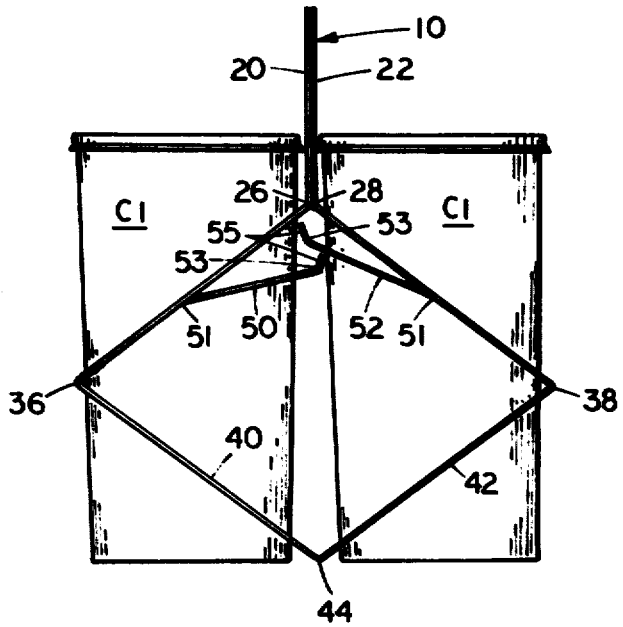
FIG. II

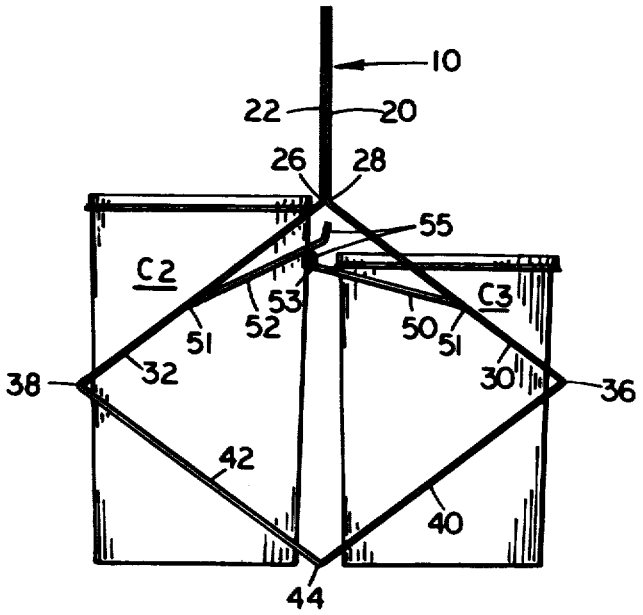
FIG. III
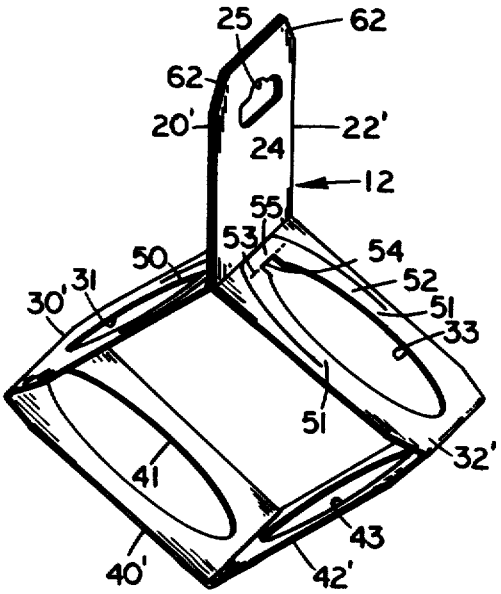
FIG. IV
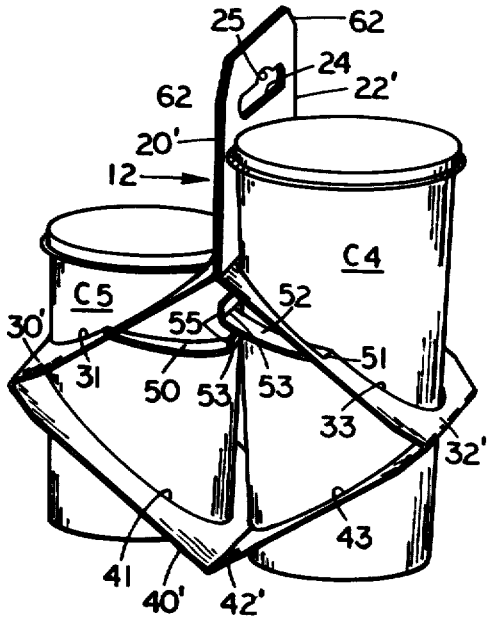
FIG. V

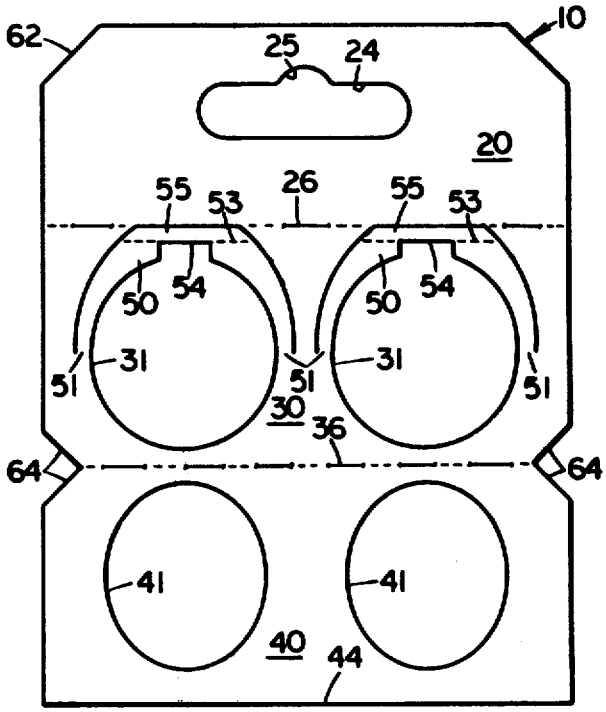
FIG. VI
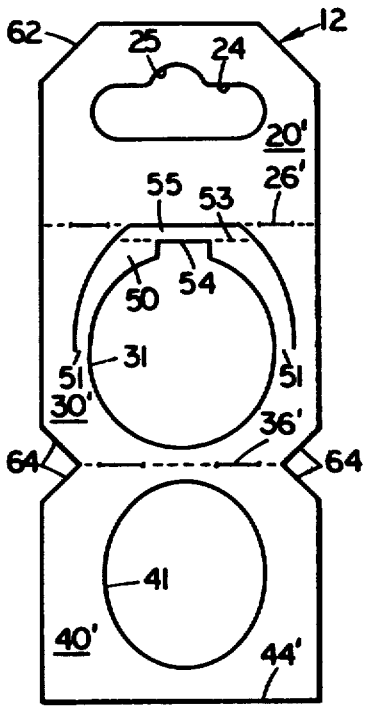
FIG. VII
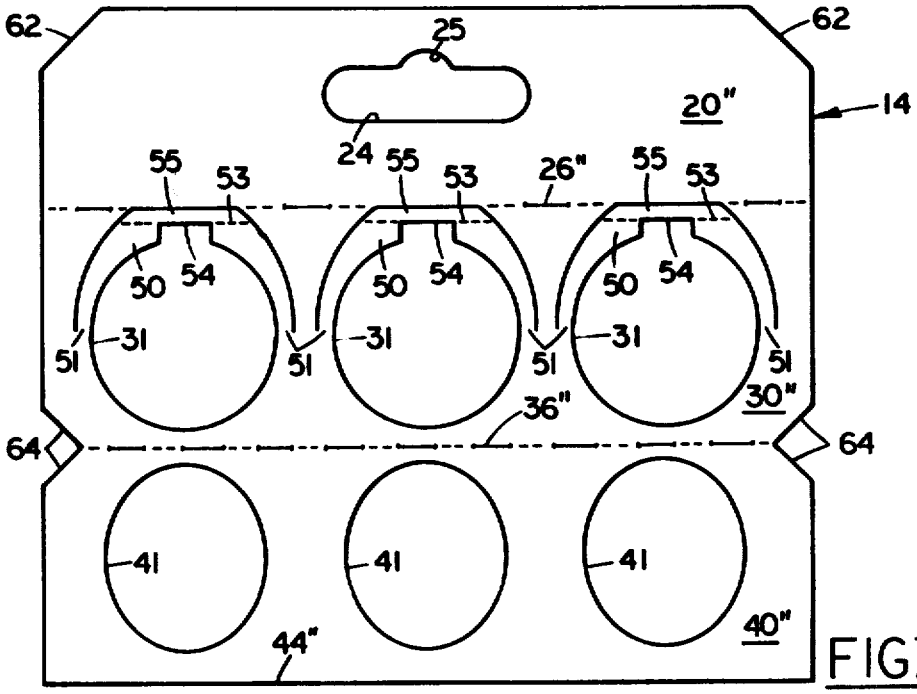
FIG. VIII

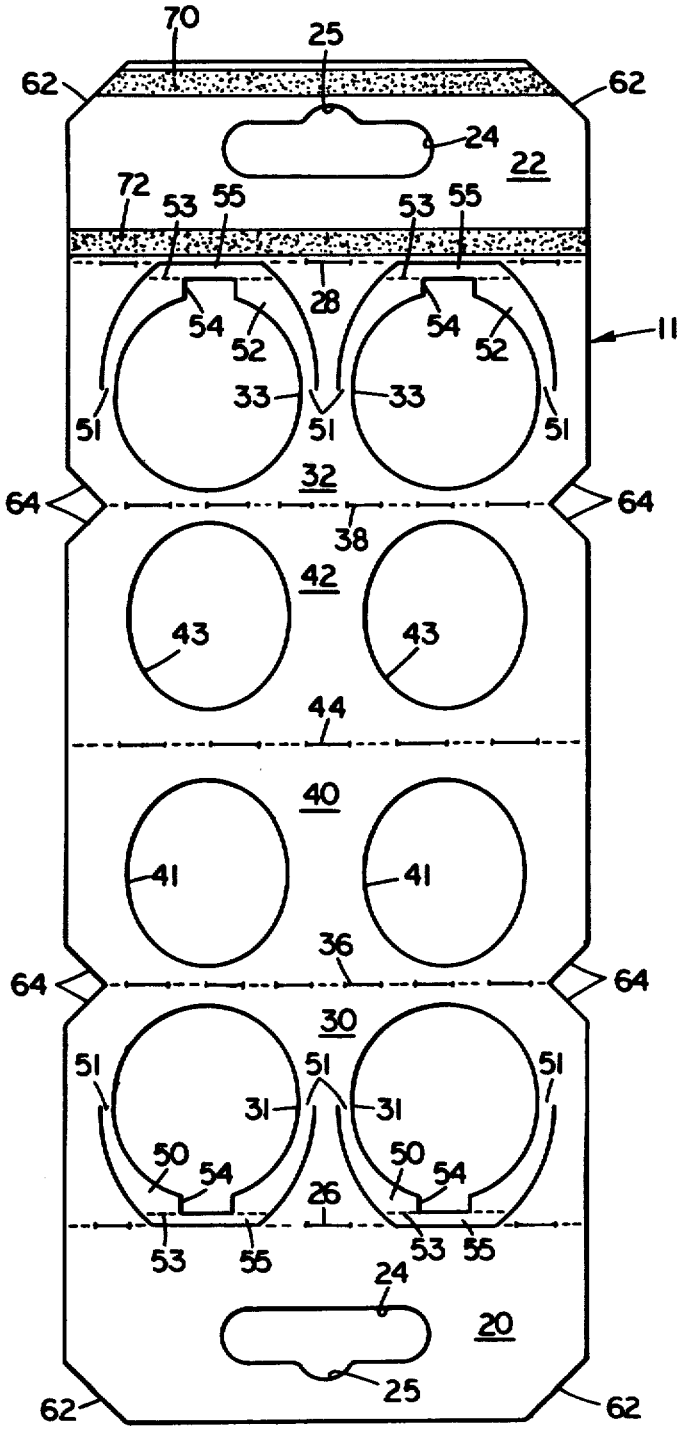
FIG. IX

UNIVERSAL CUP CARRIER

RELATED APPLICATIONS

This invention is an improvement in Forte's copending U.S. patent application, Ser. No. 844,830 filed Oct. 25, 1977, and assigned to the same assignee as this application.

BACKGROUND OF THE INVENTION

Previously, packages or carriers for vessels, such as of glass, have been made with suspending handles, partitions or apertures for the vessels in horizontal or diverging apertured and/or collared panels, and also including bottom panels for supporting the bases of the vessels to be packaged, supported or carried, such as shown in Struble U.S. Pat. No. 3,744,704 issued July 10, 1973 classified in Class 229 Sub 28 BC, and Jamison U.S. Pat. No. 3,225,959 issued Dec. 28, 1965 classified in Class 200 Sub 102 and cross-referenced in Class 206 Sub 194. Furthermore, such prior art supports or carriers without bottoms were always made for vessels of a predetermined and uniform size and shape and were not adaptable for different size and shape containers unless the dimensions of their apertures or collars were correspondingly changed, such as shown in Flamm U.S. Pat. No. 2,330,699 issued Sept. 28, 1943 classified in Class 294-87, Cunningham U.S. Pat. No. 3,727,754 issued Apr. 17, 1973 classified in Class 206 Sub 65E, and Gordon U.S. Pat. No. 3,868,140 issued Feb. 25, 1975 classified in Class 294 Sub 87.2 and cross-referenced in Class 206 Sub 139.

None of these references known to date, which are believed to be the most pertinent to applicant's cup carrier, show applicant's type of semicircular floating collar for engaging simultaneously for transport a wide variety of shapes and sizes of full drinking cups without being supported by their bottoms.

SUMMARY OF THE INVENTION

Generally speaking, the cup or drinking vessel carrier of this invention comprises a double thickness of an upwardly extending vertical fiberboard sheet handle portion or section having hingedly attached to its lower edges a pair of divergent outwardly and downwardly extending panels to the outer edges of which are hingedly attached downwardly and inwardly converging panels hingedly connected together at their lower edges directly below the handle section. Each of these upper divergent and lower convergent panels have substantially vertically aligned elongated apertures, and the apertures in the upper divergent panels having semicircular or crescent-shaped floating collars hinged at their ends diametrically of the apertures in order to engage the different size and shape frusto-conical drinking vessels carried therein. These apertures are formed to receive and clamp vessels which vary in capacity at least about 100% and also have different heights as well as diameters and tapers to their frusto-conical outside surfaces. For example, this one carrier can carry any and/or all of the seven different size cups or containers in which hot and/or cold drinks of various types are sold from fast food carry-out stores, such as in paper or plastic cups varying from say one-half pint up to a pint-and-a-half or two pints in capacity.

One of the important features of this invention is the semi-circular, C-shaped, or crescent-shaped floating collar hinged at its ends to each of the apertures in the upper divergent panels of this carrier. These collars are formed by a crescent or semicircular cut which extends from opposite sides of the upper apertures to the fold line between the divergent upper panels and the handle. Although these apertures in the upper divergent panels are elongated in a direction perpendicular to or extending away from the handle portion, they are not as elongated as the C-shaped slits forming these collars so that these collars have a crescent shape being thicker at their center portions adjacent the handle hinge line than at their attached ends on diametrically opposite sides of the narrower diameter of the elongated apertures. The elongation is primarily due to the fact that the panels when carrying a frusto-conical cup extend at angles to the vertical axes of the cup so as to form elliptical or elongated conical sections where they contact the sides of the frusto-conical cup to engage these sides.

The size of the apertures, however, are smaller than the largest diameter of the cups to be carried and larger than the smallest diameter of the smallest cup to be carried, and preferably larger than about the central diameter of such frusto-conical cups, considering the cups being placed in their vertical position with their smaller frusto-conical diameters at their bottoms and their larger frusto-conical diameters at their tops. Thus, the larger the upper half diameter of the cup size is, the more the floating collar would be bent downwardly by the weight of the cup as it grabs the sides sooner than it would for smaller cups as they are inserted into the upper divergent panel apertures. Thus, when any of the different sizes and shaped cups are inserted in the divergent upper panels, the sides of these cups are preferably engaged by the sides of the aperture when slightly more than about half of the cup has been inserted therein and before the whole cup has been inserted therein, so that in gripping the sides of the cup, the crescent-shaped collar will pull away from its surface in the plane of the panel downwardly to engage the cup and extend its freer arcuate side downwardly toward the vertical center of the carrier and toward the cup in the carrier on the other side of the handle.

In the event that the cups opposite each other on opposite sides of the handle portion fold their respective floating collars downwardly sufficiently so that they would engage each other, there is preferably provided a chord crease or score line across the crescent-shaped collar forming a segment that may be bent upwardly upon contact of the cup or its floating collar in the adjacent aperture on the other side of the carrier. This folding of this segment prevents tipping of either of the cups in the carrier. If the chord crease or score line on the crescent collar extends to close to the inner edge of the elongated cup engaging aperture, there may be provided a relief notch in the aperture, the base of which notch extends along the center portion of the chord score line. Since the apertures in the upper or divergent panel have the floating collar, their relative elongation is usually less than about 5% of the narrower diameter of the upper apertures, while the collar at its hinged or attached crescent ends has a width of about 10% of the narrower diameter of this aperture, and its wider central portion is about twice that of its ends, or 20% of the aperture's diameter, at the most elongated end of the aperture perpendicular to the fold line between the upper panel and the handle sections.

Correspondingly, the smaller diameter of the apertures in the lower or convergent panels are larger than the smaller diameter of the smallest cup to be carried in the carrier, but also are smaller than about the central diameter of the larger cups that are to be carried in this carrier. With respect to the elongation of the apertures in the lower or convergent panels, the elongation is at least about 10% and generally between 5% and 15% of the narrower diameter of these lower apertures, since these lower apertures do not contain a size compensating floating crescent-shaped collar. Similarly, since the cups inserted into the carrier are frusto-conical and the apertures in the lower convergent panels grab the lower portion or narrower portions of the cups, these apertures are correspondingly between about 5% and 10% smaller than the apertures in the upper panel.

If desired, the upper corners of the handle portion may be bevelled as well as the outer corners of the convergent and divergent panels where they are hinged together.

The single substantially rectangular blank from which the carrier of this invention may be produced comprises six substantially equal rectangular panels hinged together side-by-side with the two end panels forming the handle portion and the four intermediate panels forming the upper apertured panels and lower apertured panels, the latter two of which are hinged together at the center of the blank. The handle panels of the blank may be provided with elongated congruent apertures with a central upper notch for one's fingers, which handle panels are adhered together such as by glue strips above and below the finger apertures. Thus, the carrier when assembled from the blank in a knocked-down position comprises two equal sections or halves of the blank folded at the center fold line and with the two handle panels glued together. The joints between the panel sections are cut and/or crease or groove-scored to provide hinges which permit ready set-up of the carrier from its knockdown or flat collapsed position by pushing the handle portion toward the opposite end of the carrier to spread the diverging and converging panel portions and align their apertures vertically for the insertion of the drinking cups therein.

It is important in order to clamp the vessels of various different sizes that there is no bottom support for any of the vessels in the carrier, so that when the carrier is lifted by its handle, the angles of the upper and lower apertured panel sections will try to separate with the weight of the cups in their apertures to grab the sides of the cups and clamp them in the carrier, regardless of the level at which their different bottoms may finally take. However, once the carrier is placed on a relatively horizontal surface, the bottoms of the cups immediately conform with this surface while the upper and lower cup engaging apertures of the carrier still surround the cups to hold them together and prevent any one or more of the cups from being tipped over.

OBJECTS AND ADVANTAGES

One of the most important and unobvious features of this invention is the fact that such a simple carrier may be provided for supporting and retaining securely a variety of different shapes and sizes of cups or drinking vessels simultaneously without the necessity of providing a bottom support for any of these vessels.

Thus another object is to provide a simple, efficient, effective, economic carrier for a variety of different shapes and sizes of drinking vessels or cups.

Another object is to produce such a carrier from a single sheet of fiberboard which is easy to manufacture, uses a relatively small percentage of board and has a relatively small wastage of board or sheet material.

Still another object is to produce a beverage cup carrier for fast food stores which is stable, easy to set up, easy to carry, prevents tipping of the cups when the cups rest on a relatively horizontal surface, and automatically grips the cups when they are being transported to retain them securely and prevent them from sliding through the carrier, the grip being proportional to the weight of the material or fluid being supported in the cups. Thus, the more liquid or contents in the cups, the more stable the carrier.

BRIEF DESCRIPTION OF THE VIEWS

The above mentioned and other features, objects and advantages, and a manner of attaining them are described more specifically below by reference to embodiments of this invention shown in the accompanying drawings, wherein:

FIG. I is a perspective view of a preferred embodiment of the cup carrier of this invention supporting cups of different shapes and sizes;

FIG. II is the right end view of the embodiment shown in FIG. I, showing how the larger size cups may be engaged by the floating collars in the upper panel apertures thereof;

FIG. III is the left end view of the embodiment shown in FIG. I showing how the smaller and larger cups may be engaged by the floating collars;

FIG. IV is a perspective view of a set up two-cup carrier according to the invention shown in FIG. I before any cups have been inserted therein;

FIG. V is a perspective view of the two-cup carrier shown in FIG. IV with two different sized cups inserted therein;

FIGS. VI, VII and VIII are collapsed four-, two-, and six-cup carriers, respectively, according to the invention shown in FIG. I;

FIG. IX is a plan view of a blank for a four-cup carrier according to the embodiment shown in FIGS. I, II, III and VI.

DETAILED DESCRIPTION OF PREFERRED EMBODIMENTS

A. The Carrier

Referring to FIGS. I, II and III there is shown a four-cup carrier 10 carrying four cups, namely two large cups C1 at one end of the carrier and an intermediate and smaller cups C2 and C3, respectively, at the other end of the carrier 10. This carrier 10 as well as the other embodiments of the carrier shown in this invention all comprise the following six essential panels, namely: a double thickness handle of panels 20 and 22; a pair of divergent apertured panels 30 and 32 hingedly connected to the lower edge of the handle panels 20 and 22 by fold lines 26 and 28, respectively; and a pair of lower convergent apertured panels 40 and 42 hinged together at their lower edge 44 and at their outer edges to the outer edges 36 and 38 of the upper divergent panels 30 and 32.

Each handle panel 20 and 22 has an elongated handle aperture 24 centrally thereof which may have an upper notch portion 25 for centrally balancing the carrier when being lifted by the fingers of one's hand.

The apertures 31 and 33 in the upper divergent panels 30 and 32, respectively, are each provided with semicircular or crescent-shaped floating collars 50 and 52, which collars are the same for the apertures in the upper divergent panels of each of the embodiments shown in this description. The clear or open apertures 31 and 33 are slightly elongated in a direction perpendicular to the fold lines 26 and 28 by an amount less than about 5% of their narrowest diameter parallel to the fold lines 26, 28. When the inner arcuate edge of the crescent-shaped collars 50 or 52 engage the frusto-conical upper sides of the cups such as C1 through C5, these collars have a tendency to hinge at their narrow ends along the shorter diameters of the apertures 31 or 33 at 51. Since these crescent C-shaped or semicircular shaped collars 50 and 52 are about twice as wide at their central portions than at their hinged ends 51, there is provided a cut-score-fold line 53 extending as a chord across the central portion of the crescent floating collar 50 or 52. The outer periphery of these collars 50 or 52 also may extend to or into the fold lines 26 and 28, and thus are straight or flat along these lines 26 and 28 so as not to extend up into the handle. Furthermore, the chords 53 may extend so close to the ends of the apertures 31 and 33, respectively, that for relief in forming and to avoid interference between these scored lines and the inner edge of the apertures, a relief notch 54 may be provided at the end of each aperture 31 and 33 which extends to the fold lines 53. These fold lines 53 permit the segment-shaped ends 55 of the collars to be flexed upwardly in the event they contact an adjacent collar 50 or 52, or the side of a cup in an adjacent aperture on the other side of the handle panels 20, 22 (see FIGS. II, III and V).

The lower convergent panels 40 and 42 are also provided with elongated apertures 41 and 43, respectively, but these apertures are elongated slightly more than those in the upper or divergent panel, namely between about 5% and 10% of their shortest diameters. These apertures 41, 43 are also correspondingly smaller than the upper apertures 31 and 33, namely between about 5% and 15%, and preferably about 10%, smaller in size. This smaller size is to provide for the normal frusto-conical taper of the cups C1 through C5 which are narrower at their bottoms than at their tops. Thus, the apertures 31, 33, 41, 43 not only engage the sides of these cups when they are carried in the carrier, but also sufficiently closely surround the sides of the cups when the cups in the carrier rest on their bottoms or a supporting surface so as to prevent the cups from tipping over.

Referring to FIGS. IV, V and VII, there is shown an embodiment of a two-cup carrier 12 which has shorter panels 20', 22', 30', 32', 40' and 42', and which in FIG. IV is shown in its set-up position ready for the insertions of cups therein, and in FIG. V has the cups C4 and C5 inserted therein.

The different shaped or sized portions and elements of this two-cup carrier 12 have been singularly primed in these figures, but their functions are the same as those having the unprimed figure numbers in the four-cup carrier 10 described above.

Similarly, this is also the case for the six-cup carrier 14 shown in its collapsed position in FIGS. VIII, which contains portions and elements with double primes that are different in shape or size from those previously described.

B. The Blank

Referring now to FIG. IX, there is shown a blank 11 for producing the four-cup carrier shown in FIGS. I, II, III and VI. This blank 11 is formed of one rectangular piece of sheet material, such as fiberboard or paperboard, which is divided by crease, score, or fold lines 26, 36, 44, 38 and 28, consecutively, into substantially six equal rectangular panels 20, 30, 40, 42, 32 and 22, respectively. This blank 11 in the manufacture of the carrier 10 is cut out to form the apertures 24, 31, 33, 41 and 43. The outer corners of this blank 11 may be provided with notches or bevelled corners 62 which form the upper corners of the handle portion panels 20, 22. Similarly, the ends of the fold lines 36 and 38 may have notches 64 to provide bevelled corners for the outer diverging and converging panels as also shown in FIG. I. Before the blank 11 is formed into a collapsed carrier 10 as shown in FIG. VI, it is folded along its center crease line 44 after a pair of glue strips 70 and 72 have been placed on the inside of at least one of the handle panels, such as panel 22, so as to adhere these panels 20, 22 into a unit or integral handle portion for the carrier. Other means than glue or adhesive may be used for fastening the two handle panels 20, 22 together, such as staples or the like, without departing from the scope of this invention.

While there is described above the principles of this invention in connection with specific articles, it is to be clearly understood that this description is made only by way of example and not as a limitation to the scope of this invention.

I claim:

1. A universal collapsible cup carrier for simultaneously carrying a plurality of divergent sizes and shapes of frusto-conical drinking cups comprising:

(A) a handle portion having an aperture therein and comprising two panels adhered together, (B) a pair of divergent upper panels hinged to the lower edges of said handle panels and each upper panel having at least one cup aperture therein, each of said cup apertures having a crescent-shaped floating collar whose ends are attached diametrically of its aperture parallel to the hinge of said panel to said handle portion, and (C) a pair of convergent lower panels hinged to the outer lower edges of said upper panels and to each other at their lower edges, and each lower panel having at least one cup aperture therein vertically aligned with a cup aperture in said upper panel, said lower cup apertures being elongated between about 5% and 10% in the direction toward said handle portion.

2. A carrier according to claim 1 wherein said lower cup apertures are between about 5% and 15% smaller in size than the apertures in said divergent upper panels.

3. A carrier according to claim 1 wherein said apertures in said divergent upper panels are less than about 5% elongated.

4. A carrier according to claim 1 wherein said floating collars are about twice as thick at their free curved edges than they are at their attached ends.

5. A carrier according to claim 1 wherein each of said floating collars have a chord fold line about midway of its thickest crescent portion.

6. A carrier according to claim 5 wherein each of said upper apertures has a relief notch in the center of its floating collar to said chord fold line.

7. A carrier according to claim 1 wherein said handle portion has outer upper bevelled corners.

8. A carrier according to claim 1 wherein the outer ends of said divergent upper and convergent lower panels have bevelled corners.

9. A carrier according to claim 1 wherein said aperture in said handle portion is elongated.

10. A carrier according to claim 9 wherein said aperture in said handle portion has a central finger engageable notch therein.

11. A blank of fiberboard for forming a universal cup carrier for simultaneously carrying a plurality of different sizes and shapes of frusto-conical drinking cups, said blank comprising: a single rectangular sheet of fiberboard divided by transverse hinge creases into six rectangular panels of substantially the same size, the two end panels having congruent handle apertures therein and the four intermediate panels each having the same number of cup-carrying apertures therein, the cup-carrying apertures in the outer two intermediate panels having semicircular floating collars at the handle panel side of said apertures attached at their ends diametrically of their said apertures parallel to said hinge creases.

12. A blank according to claim 11 wherein each intermediate panel has between one and three cup-carrying apertures therein.

13. A blank according to claim 11 wherein the cup-carrying apertures in the inner two intermediate panels are elongated between about 5% and 10% in the direction of said end panels.

14. A blank according to claim 11 wherein said cup-carrying apertures in said two outer intermediate panels are between about 5% and 15% larger in size than the cup-carrying apertures in said two inner intermediate panels.

15. A blank according to claim 11 wherein said cup-carrying apertures in said outer two intermediate panels are less than about 5% elongated.

16. A blank according to claim 11 wherein said floating collars are about twice as thick at their free curved edges than they are at their attached ends.

17. A blank according to claim 11 wherein each of said floating collars comprises a chord fold line about midway of its thickest crescent portion.

18. A blank according to claim 17 wherein each of said cup-carrying apertures in said two outer intermediate panels has a relief notch in the center of its floating collar to said chord fold line.

19. A blank according to claim 11 wherein its outer corners are bevelled.

20. A blank according to claim 11 wherein the ends of the hinge creases between said inner and said outer intermediate panels are notched.

21. A blank according to claim 11 wherein said aperture in said two end handle panels is elongated.

22. A blank according to claim 21 wherein said aperture in said two end handle panels has a central finger engageable notch therein.

* * * * *